United States Patent [19]

Teasel

[11] 3,994,457

[45] Nov. 30, 1976

[54] CROSSING GATE

[75] Inventor: William A. Teasel, Bloomfield Hills, Mich.

[73] Assignee: National Foundry Sand Company, Bloomfield Hills, Mich.

[22] Filed: July 28, 1975

[21] Appl. No.: 599,905

[52] U.S. Cl. ..... 246/125; 49/93

[51] Int. Cl.[2] ..... B61L 29/04

[58] Field of Search ..... D28/1 B; 49/93; 246/125, 127, 261, 272, 292, 293, 474, 479, 482, 483

[56] References Cited

FOREIGN PATENTS OR APPLICATIONS

| | | | |
|---|---|---|---|
| 1,271,355 | 7/1961 | France | 246/125 |
| 1,113,238 | 8/1961 | Germany | 246/125 |
| 1,405,696 | 3/1969 | Germany | 246/125 |
| 1,126,910 | 4/1962 | Germany | 246/125 |
| 360,091 | 3/1962 | Switzerland | 246/293 |
| 1,215,331 | 12/1970 | United Kingdom | 246/293 |

*Primary Examiner*—Stephen G. Kunin
*Attorney, Agent, or Firm*—Reising, Ethington, Barnard, Perry and Brooks

[57] ABSTRACT

A railway pivotal crossing gate is made with a modular construction to facilitate repair of the gate. The gate modules are preferably of alternating colors along the length of the gate and have exposed parallelogram configurations so the gate has slash markings. Each module includes an elongated body that is preferably injection molded from a translucent plastic with a hollow construction. Male and female ends of each module interfit with ends of adjacent modules to permit self-threading fasteners to interconnect the modules in a detachable manner. Lights are mounted within certain modules so these modules glow and thereby light the gate. Interconnected wire harnesses of the modules are utilized to energize the lights. The unlighted modules preferably mount light reflectors. The gate modules may have hollow rectangular or trapezoidal cross-sections, the latter being useful in conserving the material from which the modules are molded. A mounting module at the end of the gate which is pivotally supported has a lower impact strength than the other modules so that the gate breakage normally occurs at this mounting module.

32 Claims, 6 Drawing Figures

CROSSING GATE

BACKGROUND OF THE INVENTION

1. Field of the Invention

This invention is directed toward railway pivotal crossing gates for blocking the path of vehicle travel along a roadway that crosses railroad tracks.

2. Description of the Prior Art

Railway crossing gates of the pivotal type are utilized to block the path of vehicle travel along a roadway that crosses railroad tracks. This type of crossing gate has an elongated configuration that extends in a horizontal blocking position across the roadway when a train is approaching or crossing the roadway. The gate also has a vertical position where it allows vehicles to travel along the roadway over the railroad tracks.

Government regulations require railway pivotal crossing gates to have slash markings of alternating colors along their lengths so the gates can readily be seen in their road blocking position by an approaching motorist. The gates have also included reflectors and flashing lights so they appear more prominent to the motorist. Theft and/or vandalism of the flashing lights mounted on the gates have been a problem in the past.

Occasionally, a motorist approaching a railway crossing gate will misjudge his braking distance and impact the gate sufficiently hard to break it. The gate then, of course, is no longer able to perform its intended function and must be repaired or replaced. Repair of such a gate has heretofore been provided by splints that are utilized to interconnect the broken gate portions.

SUMMARY OF THE INVENTION

The present invention is directed toward a railway pivotal crossing gate that is made of a modular construction and also to the gate modules. The modular construction of the gate allows it to be repaired by removing broken modules and then securing the unbroken ones to each other with or without replacement modules.

Each module of the gate includes an elongated body with first and second ends that interfit with ends of adjacent modules so as to permit detachable securement of the modules to each other. Preferably, each module has a male end and a female end that resepectively interfit with female and male ends of adjacent modules. Threaded fasteners are utilized to secure the interfitted module ends to each other. The threaded fasteners are preferably of a self-threading type so that no threads need be provided within the holes receiving the fasteners.

When secured to each other, the modules have exposed portions that have parallelogram configurations. Modules of alternating colors are positioned along the length of the gate so that the exposed parallelogram configurations provide the required slash markings for the gate.

Translucent plastic is preferably utilized to injection mold the modules with a hollow construction. Certain of the modules have lights mounted within their interiors so that illumination from the lights causes the modules to glow. The positioning of the lights within the interior of the modules also alleviates any theft and/or vandalism problem with the lights. The lights are energized by interconnected wiring harnesses that extend along the length of the modules. Preferably, the modules are alternately lighted and unlighted along the length of the gate, and the unlighted modules include light reflectors for reflecting light from approaching vehicles.

The gate modules may have a rectangular cross-section or a trapezoidal cross-section that points downwardly in the horizontal roadway blocking position of the gate. The trapezoidal cross-section of the gate reduces the amount of plastic material necessary to injection mold each module as compared to the amount required for the rectangular cross-section.

The end of the gate which is pivotally mounted to a base preferably includes a mounting module that has a lower impact strength then the other modules of the gate. Consequently, breakage of the gate will normally occur at the mounting module with the other modules of the gate remaining intact. This mounting module is thus the one which is normally replaced to repair the gate after it has been impacted by a vehicle. Nevertheless, when one of the other modules is broken, the gate can still be repaired with minimal effort in comparison with past gates of this type.

The objects, features and advantages of the present invention are readily apparent from the following detailed description of the preferred embodiment taken in connection with the accompanying drawings.

DETAILED DESCRIPTION OF THE PREFERRED EMBODIMENTS

Figure 1:
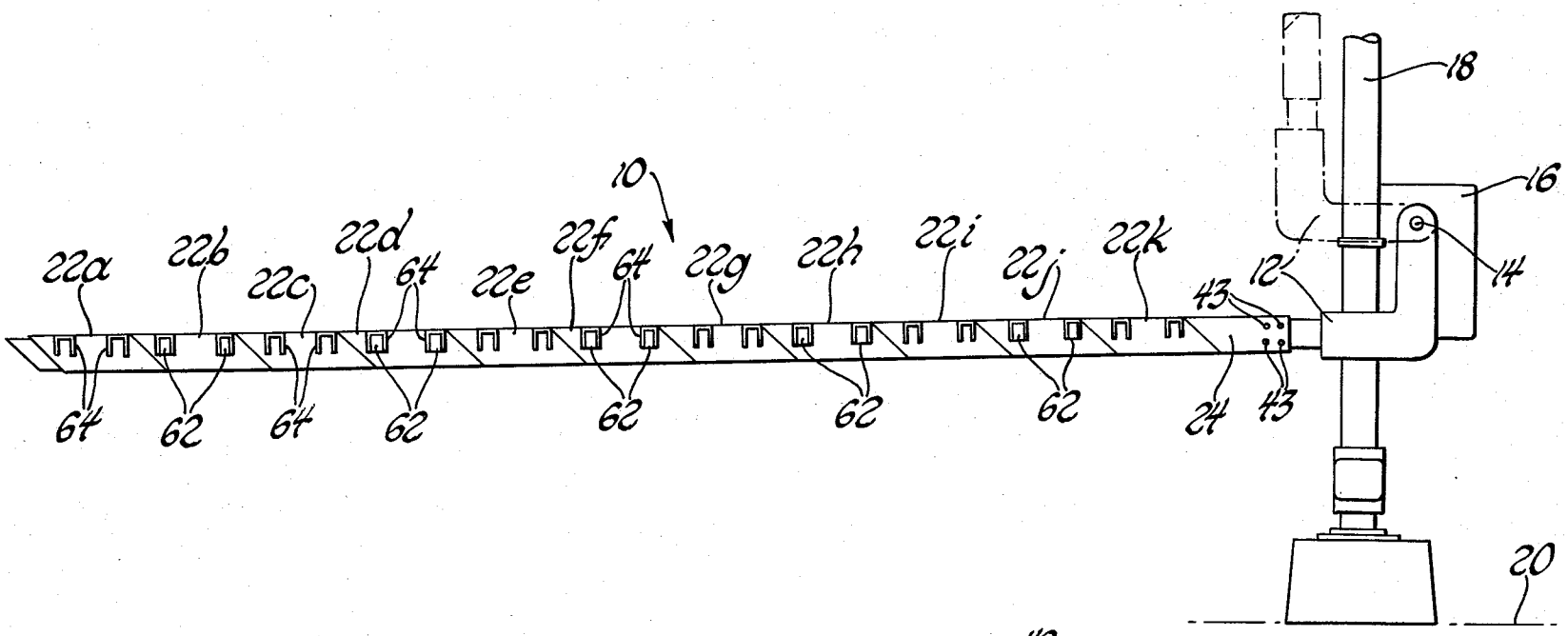
FIG. 1 is a side elevation view of a railway crossing gate that is constructed in a modular manner according to the present invention.

Referring to FIG. 1 of the drawings, reference numeral 10 indicates a railway pivotal crossing gate that is constructed in a modular manner in accordance with the present invention. The crossing gate 10 is mounted on a pivotal arm 12 of a somewhat L-shaped configuration. The arm 12 is supported by a rotatable shaft 14 of an actuator mechanism that is enclosed within a housing 16. The housing 16 is mounted on a post 18 that extends upwardly in a vertical direction from the ground 20. The actuator mechanism within the housing 16 moves the gate 10 between its horizontal position shown by solid lines and its vertical position shown by phantom lines. In the horizontal position, the elongated configuration of the gate extends horizontally over a vehicle roadway and blocks the path of vehicle travel along the roadway over adjacent railroad tracks. In the vertical position, the gate allows the vehicle travel along the roadway over the railroad tracks.

The crossing gate 10 includes a plurality of elongated gate modules **22*a*–22*k* that are secured to each other in an end-for-end manner. The end of the gate adjacent post 18 includes a mounting module 24 that supports the gate on the pivotal arm 12. The mounting module 24 has a lower impact strength than the other gate modules 22. Consequently, the gate 10 will normally break at the mounting module 24 when it is impacted. The mounting module is then replaced with a new one to repair the gate. Likewise, when one of the other modules 22** is broken, it may be detached from the unbroken ones which are then secured to each other with or without replacement modules to repair the gate. If no replacement modules are utilized, the gate will have a shorter length after it is repaired while it will have the same length if replacement modules are utilized.

With additional reference to FIGS. 2 through 4 and 6, each gate module 22 includes an elongated body 26 that is molded from plastic with a hollow construction. The plastic body 26 of the module includes a male end 28 as well as a female end 30. The male end is of a slightly smaller size than the female end so that it is capable of interfitting within the female end of a like module of the same size and shape. The module body includes upper and lower walls 32 and 34 as well as opposite side walls 36. The male end of the module includes holes 38 in the upper and lower walls while the female end of the module includes holes 40 in these walls. If the module 22 were severed intermediate its ends, the male end 28 would be received within the female end 30 so that the male end holes 38 would be aligned with the female end holes 40. Consequently, a number of the modules can be interfitted within each other and detachably secured to each other by threaded fasteners 42 received within their aligned holes 38 and 40. Preferably, the threaded fasteners are of the self-threading type and form their own threads as they are threaded into the plastic material of the gate modules.

The gate modules 22 are preferably injection molded from polycarbonate plastic which has a very high impact strength. This high impact strength, of course, makes this type of plastic desirable for use in molding the gate modules. The mounting module 24 for the gate is made from approximately 90% of the polycarbonate plastic and 10% glass fibers that give the mounting module a somewhat lower impact strength but a greater strength under static loading conditions. The mounting module has a greater static load with the gate in its horizontal position than do any of the other gate modules and this greater static strength of the module prevents it from being subjected to any creep deformation. On the other hand, when the gate is impacted by a vehicle, the lower impact strength of the mounting module causes it to break. The gate can then be repaired by the addition of a new mounting module. The mounting module includes a body having a male end that is received within the female end of the adjacent gate module **22*k*, FIG. 1, in a detachable manner by the threaded fasteners in the same way the other modules are secured to each other so as to permit this replacement. The other end of the mounting module body is secured by threaded fasteners 43 to the arm 12 in a detachable manner to also allow the replacement of the mounting module 24. Likewise, when one of the other gate modules 22** breaks due to a vehicle impact or otherwise, it can be removed from the unbroken ones which are then secured to each other with or without replacement modules to repair the gate. Of course, the gate will have a shorter length if no replacement modules are utilized. The gate can be initially made slightly longer than necessary so that shortening of the gate will not stop it from performing its intended function.

The side walls 36 of the gate modules 22 have exposed portions with parallelogram configurations when the modules are secured to each other as shown in FIG. 1. Preferably, the adjacent modules are molded from plastic of alternating colors along the length of the gate. Thus, the modules **22*a*, 22*c*, 22*e*, 22*g*, 22*i* and 22*k* may be made of a red color while the modules 22*b*, 22*d*, 22*f*, 22*h*, and 22*j*** may be made of a white or black color. The exposed parallelogram configuration of each gate module thus gives the gate the slash markings that are required by government regulations for railway crossing gates without performing any painting or such of the gate.

Figure 2:
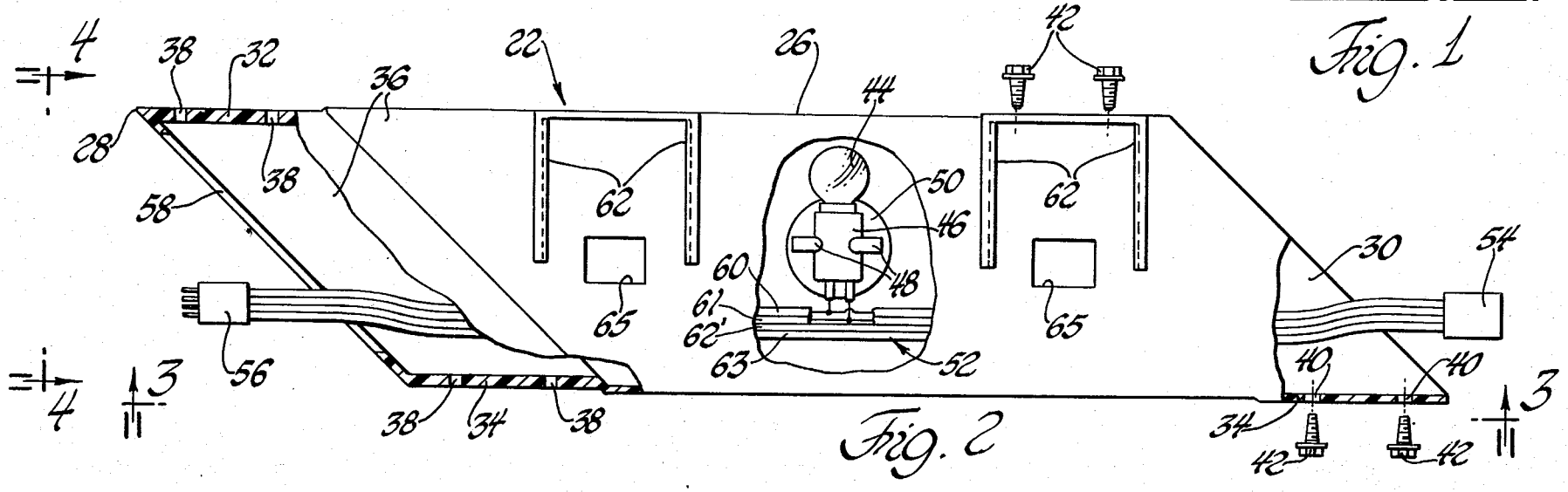
FIG. 2 is an enlarged side view of one of the modules of the gate.
Figure 3:
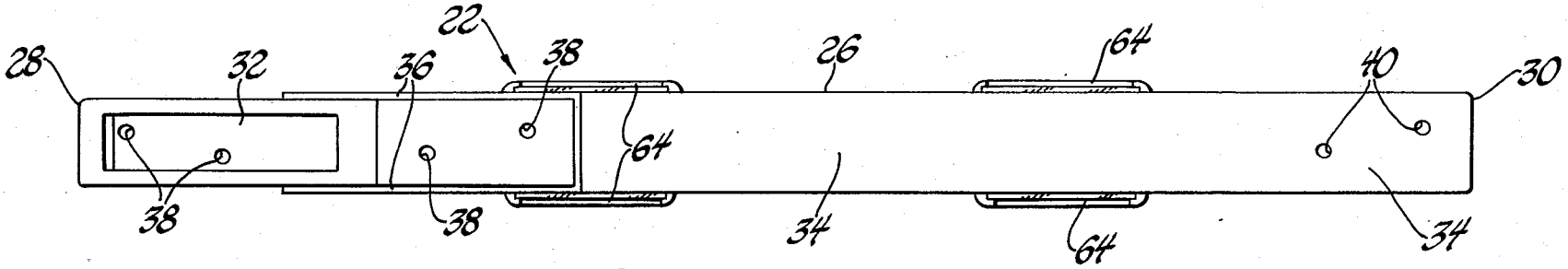
FIG. 3 is a bottom plan view of the gate module taken along the line 3—3 of FIG. 2.
Figure 6:
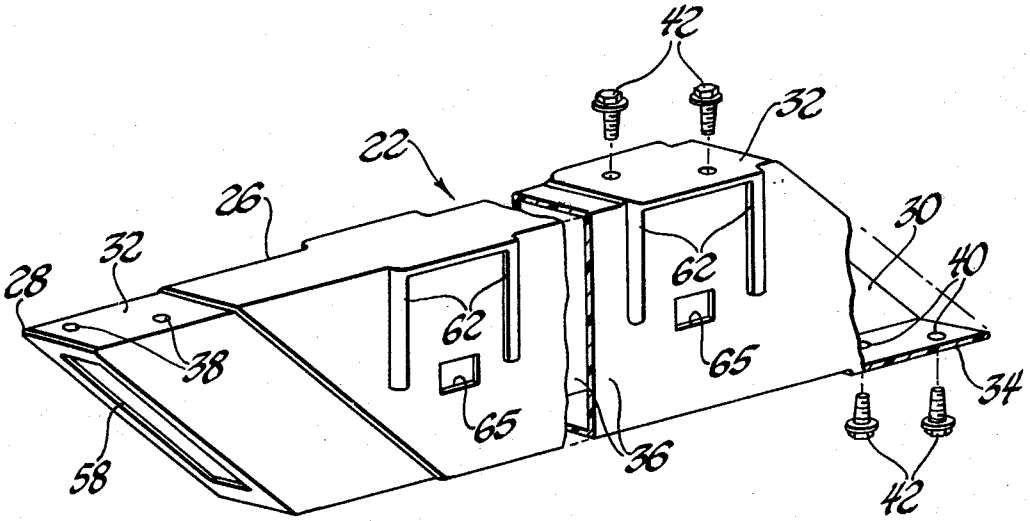
FIG. 6 is a partially broken away perspective view of a gate module.

The gate modules 22 may be provided with lights 44, FIG. 2, mounted within the interior of their hollow plastic body 26. The light is received by a socket 46 that is suitably secured by a snap action between lugs 48 of a mounting plate 50. The mounting plate 50 is secured in a suitable manner to one of the module side walls 36 so as to mount the light within a central portion of the module. The polycarbonate plastic from which the module body is preferably injection molded is translucent so that illumination from the light 44 causes the module to glow. Consequently, a gate formed by a number of the lighted modules is highly visible to an approaching motorist.

Each gate module 22 includes a wiring harness 52, FIG. 2, extending between its opposite ends within the interior of the plastic module body 26. The wiring harness includes a female socket 54 at the female end of the module and a male socket 56 that extends outwardly through an opening 58 in the male end of the module. During assembly of a gate including a plurality of the modules, adjacent male and female sockets of the wiring harnesses are thus interconnected prior to interfitting of the module ends and detachable securement of these ends by the threaded fasteners. It is preferable for the wiring harness 52 to have four wires 60, 61, 62' and 63 in order to establish a constant and flashing light pattern. The wire 60 acts as a common ground for all of the light energizing circuits. The wire 61 provides a hot wire for the light 44 shown in FIG. 2 and energizes this light in a flashing manner. The wire 62' likewise provides a hot wire for energizing lights of other modules in a flashing manner out of phase with those energized by wire 61. The wire 63 provides a hot wire for constantly energizing the light of the gate module **22*a* at the free end of gate 10, as shown in FIG. 1.**

The gate modules along the length of the gate are preferably alternately lighted and unlighted as well as being of alternating colors. The modules which are unlighted mount suitable reflectors 62, FIG. 1, for reflecting the shining lights of vehicles approaching the gate. These reflectors are mounted on the side of walls 36 of the gate modules by integral U-shaped portions 64 of the modules that open downwardly to define slots for receiving the reflectors. The back side of the reflectors may be adhesively secured to the module side wall or a suitable mechanical fastener may be utilized to hold the reflectors in position. Adjacent the open ends of the U-shaped portions 64, the module side walls 36 include openings 65 that are defined by supports for a central core used during injection molding of the module. Any water that may enter the module, such as through these openings 65 or otherwise, will drain downwardly when the gate is in its vertical position. The water will pass through the openings 58 in the male ends of the modules and out through a suitable drain hole in the mounting module 24.

Figure 5:
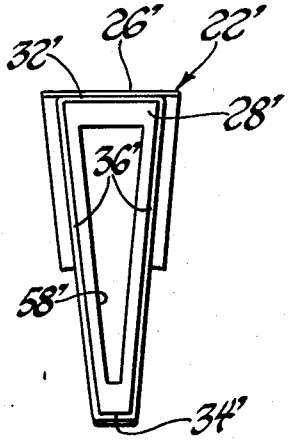
FIG. 5 is a view similar to FIG. 4 of an alternate embodiment of the gate module.
Figure 4:
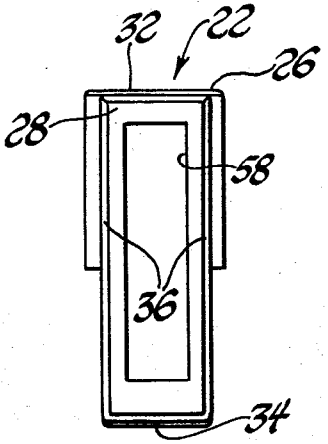
FIG. 4 is an end view of the gate module taken along line 4—4 of FIG. 2.

The hollow cross-section of each gate module does not necessarily have to be rectangular but may be trapezoidal, as shown in the alternate embodiment 22' of FIG. 5. This module has side walls 36' that are of the same length, with the trapezoidal configuration of the module cross-section pointing in a downward direction when the gate is in its horizontal roadway blocking position. This trapezoidal configuration requires less material than the rectangular configuration of the FIG. 4 embodiment. The larger upper wall 32' of this trapezoidal embodiment is in tension with the gate in its horizontal position while its smaller, lower wall 34' is in compression. The plastic material from which the gate module is molded has less of a tendency to deform under compression than under tension. Consequently, the tendency of the upper and lower walls to deform is somewhat equalized by this differential area between them.

While preferred embodiments have been described, those skilled in the art will recognize various alternative constructions and designs as defined by the following claims.

What is claimed is:

1. A railway pivotal crossing gate for blocking the path of vehicle travel along a roadway at a railroad crossing in a horizontal position of the gate and for permitting such vehicle travel upon pivotal movement to a vertical position, the gate comprising: a plurality of identical elongted modules having uniform cross-sections; each module including a unitary body having first and second integral ends that are homogeneous with the body; the first and second ends of the modules respectively interfitting with the second and first ends of other adjacent modules with an overlapping relationship in an end-to-end manner; means detachably securing the modules to each other in the end-to-end manner; the modules cooperating to give the gate an elongated configuration that is pivotal between the vertical and horizontal positions of the gate; and a module which is broken by a vehicle impact or otherwise being detachable from the other unbroken modules which may then be secured to each other to provide a shorter gate or with a replacement module so the gate has the same length.

2. A gate according to claim 1 wherein the modules are of alternating colors along the length of the gate, each module being of only one color between its ends.

3. A gate according to claim 2 wherein the modules have exposed and skewed parallelogram configuration so that their alternating colors appear as slash markings along the length of the gate.

4. A gate according to claim 1 wherein the modules each have male and female ends, each intermediate module having its male end inserted into the female end of an adjacent module and having its female end receiving the male end of another adjacent module.

5. A gate according to claim 1 wherein certain of the modules include light reflectors.

6. A gate according to claim 1 wherein each module is molded from plastic.

7. A gate according to claim 1 wherein each module has a rectangular cross-section.

8. A gate according to claim 1 wherein each module has a trapezoidal cross-section.

9. A gate according to claim 8 wherein the trapesoidal cross-section of the modules points downwardly in the horizontal roadway blocking position of the gate.

10. A gate according to claim 9 wherein the trapezoidal cross-section of the modules has sides of equal length.

11. A gate according to claim 1 wherein the means for detachably securing the modules includes threaded fasteners.

12. A gate according to claim 11 wherein the threaded fasteners are self-threading.

13. A gate according to claim 1 wherein one of the ends thereof includes a mounting module having lower impact strength than the other modules so the gate will normally break at the mounting module upon being impacted.

14. A gate according to claim 1 wherein a plurality of the modules support light for lighting the gate.

15. A gate according to claim 14 wherein the modules are of a hollow construction and the lights are located within their associated modules.

16. A gate according to claim 15 wherein the modules having lights are made of translucent plastic so these modules glow when the lights are energized.

17. A gate according to claim 16 wherein the modules are alternatively lighted and unlighted along the length of the gate.

18. A gate according to claim 16 wherein the modules having internal lights are made of red translucent plastic.

19. A gate according to claim 15 wherein the modules each include a wire harness for energizing the lights.

20. A railway crossing gate module comprising: an elongated unitary body having first and second integral ends that are homogeneous with the body; the first end of the body having a configuration that would interfit with the second end thereof in an overlapping relationship if the body were severed along its length; the interfitting and overlapping relationship of the ends of the body permitting the module to be detachably secured in an end-to-end manner with other like modules so as to cooperate therewith to provide a railway crossing gate for blocking a roadway in a horizontal position and for permitting such travel upon pivotal movement to a vertical position; and a roadway crossing gate made from a plurality of the modules being reusable upon breakage of one or more of its modules by detaching all broken modules and securing the unbroken ones to each other with or without replacement modules.

21. A gate module according to claim 20 whose body has a male and a female end.

22. A gate module according to claim 21 wherein the body has an exposed and skewed parallelogram configuration when secured to other modules.

23. A gate module according to claim 20 wherein the module includes means for mounting light reflectors.

24. A gate module according to claim 20 wherein the body is molded from plastic.

25. A gate module according to claim 20 wherein the cross-section of the body is hollow and rectangular.

26. A gate module according to claim 20 wherein the cross-section of the body is hollow and trapezoidal and points downwardly in the roadway blocking position of the gate which the module cooperates with other like modules to provide.

27. A gate module according to claim 20 wherein the body is molded from translucent plastic with a hollow construction.

28. A gate module according to claim 27 wherein a light is mounted within the hollow interior of the module so that illumination therefrom causes the module to glow.

29. A gate module according to claim 28 that includes a wire harness for energizing the light, the harness extending between the opposite ends of the module for attachment to wire harnesses of adjacent modules to which the module is to be secured.

30. A gate module according to claim 20 whose first and second ends include holes for receiving threaded fasteners for detachably securing the module to other like modules.

31. A mounting module for a railway crossing gate, the mounting module comprising: a plastic body having a first end that is detachably secured to a pivotal support member and a second end that is detachably secured to one end of a plastic gate module that cooperates with other like modules to provide an elongated railway pivotal crossing gate, and the plastic body of the mounting module having glass fibers therein so as to have a lower impact strength than the modules of the gate supported thereby such that an impact failure will normally occur at the mounting module which may then be replaced to repair the gate.

32. A mounting module as in claim 31 wherein the plastic body is made from polycarbonate plastic with about 10 percent glass fibers.

* * * * *